US006340795B1

(12) United States Patent
Caldwell

(10) Patent No.: US 6,340,795 B1
(45) Date of Patent: Jan. 22, 2002

(54) ELECTRICAL CABLE

(75) Inventor: Barry Caldwell, Hesston, KS (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/617,160

(22) Filed: Jul. 17, 2000

(51) Int. Cl.[7] ..... H01B 7/08
(52) U.S. Cl. ..... 174/117 FF
(58) Field of Search ..... 174/117 F, 117 FF, 174/68.2, 99 B, 70 B, 71 B, 72 B, 133 B

(56) References Cited

U.S. PATENT DOCUMENTS 1,853,677 A * 4/1932 Fischer ..... 174/117 FF
2,376,307 A * 5/1945 Bosch ..... 174/117 FF
3,964,816 A 6/1976 Narozny ..... 439/397
4,533,200 A 8/1985 Wilson ..... 439/395
4,692,566 A * 9/1987 Kauffman ..... 174/117 FF
4,713,025 A 12/1987 Soma ..... 439/752
5,059,137 A 10/1991 Dale et al. ..... 439/395
5,091,610 A * 2/1992 Strauss ..... 174/117 F
5,854,445 A * 12/1998 Graham et al. ..... 174/99 B
6,132,236 A 10/2000 Kozel et al ..... 439/395

* cited by examiner

*Primary Examiner*—Chau N. Nguyen
(74) *Attorney, Agent, or Firm*—Suiter & Associates PC

(57) ABSTRACT

The present invention is directed to an electrical cable. An electrical cable may include a first flat conductor surrounded by an insulator and a second flat conductor surrounded by an insulator, wherein the first flat conductor and the second flat conductor are spaced so as to form an electrical differential pair.

18 Claims, 2 Drawing Sheets

ELECTRICAL CABLE

FIELD OF THE INVENTION

The present invention generally relates to the field of cables, and particularly to electrical cables.

BACKGROUND OF THE INVENTION

Data transmission is one of the most important aspects in modem life. With the increase in processor speeds and devices that are able to perform their functions in an increasingly faster manner, the transmission of the resulting information must be transmitted even faster to realize these advances. For example, currently, round wire conductor (RWC) is used which does not allow the density needed for very high-density cable interconnect (VHDCI) and other very high density connects on cabling for I/O data applications. This is because center to center spacing and wire size plus impedance controls are currently being utilized at the limit of practical usage in a commercial environment. Thus, there exists a need for an electrical cable suitable for increased data transmission. For instance, there is a need for an easy to use differential vertically paired flat conductor cable (FCC) and a high density controlled impedance differential paired cable suitable for use with low voltage differential signals (LVDS) in I/O data applications.

SUMMARY OF THE INVENTION

Accordingly, the present invention is directed to an improved electrical cable. In a first aspect of the present invention, an electrical cable includes a first flat conductor surrounded by an insulator and a second flat conductor surrounded by an insulator, wherein the first flat conductor and the second flat conductor are spaced so as to form an electrical differential pair.

In a second aspect of the present invention, an electrical cable includes a first pair of electrical conductors. The first pair of electrical conductors includes a first flat conductor surrounded by an insulator and a second flat conductor surrounded by an insulator. The first flat conductor and the second flat conductor are spaced so as to form an electrical differential pair. The electrical cable also includes a second pair of electrical conductors including a third flat conductor surrounded by an insulator and a fourth flat conductor surrounded by an insulator. The third flat conductor and the fourth flat conductor are spaced so as to form an electrical differential pair. A spacer is disposed between the first pair of electrical conductors and the second pair of electrical conductors. The spacer is formed so as to isolate an electromagnetic field from the first pair of electrical conductors from an electromagnetic field from the second pair of electrical conductors so as to reduce cross talk and between the pairs.

In a third aspect of the present invention, an electrical cable includes a first pair of electrical conductors. The first pair of electrical conductors includes a first flat conductor surrounded by an insulator and a second flat conductor surrounded by an insulator. The first flat conductor and the second flat conductor are spaced so as to form an electrical differential pair. The electrical cable also includes a second pair of electrical conductors including a third flat conductor surrounded by an insulator and a fourth flat conductor surrounded by an insulator. The third flat conductor and the fourth flat conductor are spaced so as to form an electrical differential pair. A spacer is disposed between the first pair of electrical conductors and the second pair of electrical conductors. The spacer is formed so as to control an electromagnetic envelope of the first pair of electrical conductors with respect to the second pair of electrical conductors.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
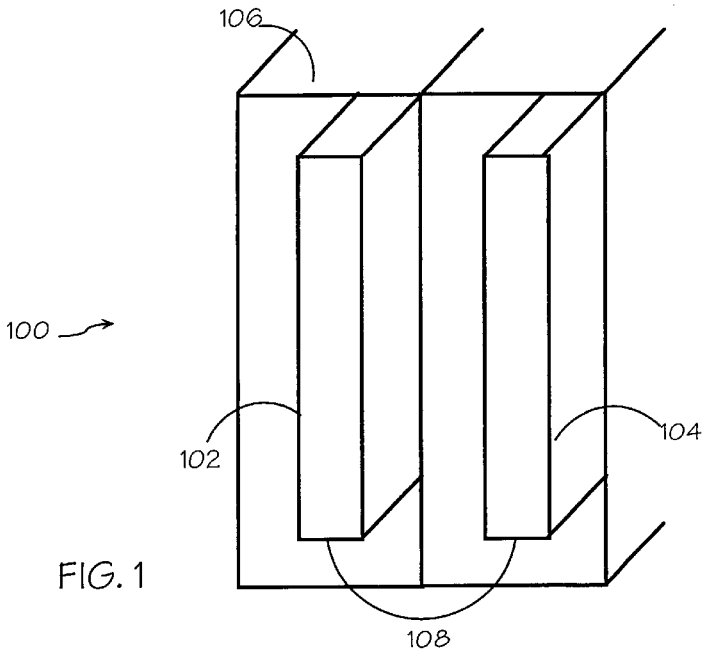
FIG. 1 is an illustration of an exemplary embodiment wherein two conductors are paired together to create an electrical pair of flat conductors.

Referring now to FIG. 1, an exemplary embodiment of the present invention is shown wherein two conductors are paired together to create an electrical pair of flat conductors. A cable 100 includes a first vertical flat conductor 102 and a second vertical flat conductor 104. Preferably, the first vertical flat conductor 102 and the second vertical flat conductor 104 are formed out of copper or another metal that is electrically conductive. An insulator 106 is formed so as to surround the first vertical flat conductor 102 and the second flat conduct 104.

Preferable, the first vertical flat conductor 102 and the second vertical flat conductor 104 are paired together to create an electrical pair of vertical flat conductors with a spacing geometry 108 to create an effective electrical differential pair. For example, a signal may be carried on both the first vertical flat conductor 102 and the second vertical flat conductor 104. The voltage on these two conductors may then be utilized to determine whether the signal is a logical one, or a logical zero. By using both the first vertical flat conductor 102 and the second vertical flat conductor 104 to carry a differential signal, interference may be greatly reduced by spacing the first vertical flat conductor 102 and the second vertical flat conductor 104 so that interference signals are common to both conductors, and therefore cancel out.

Preferable, the insulator 106, first vertical flat conductor 102 and second flat conduct 104 are fabricated from a material that provides both the desired respective electrical properties, for example conductivity, dielectric insulation, and the like, and desired respective physical properties such as flexibility such that cable 100 is at least a partially flexible structure. Vertical flat conductors are desirable because they easier to control both the width and depth of material of the conductor as well as the spacing between the conductors. Thus, the capacitance, cross talk, conductance, impedance and DC resistance may be more easily controlled as desired by a user. Additionally, the electrical cable may be formed using extrusion technology, thereby enabling the cable to be produced in a time efficient and cost-effective manner.

Figure 2:
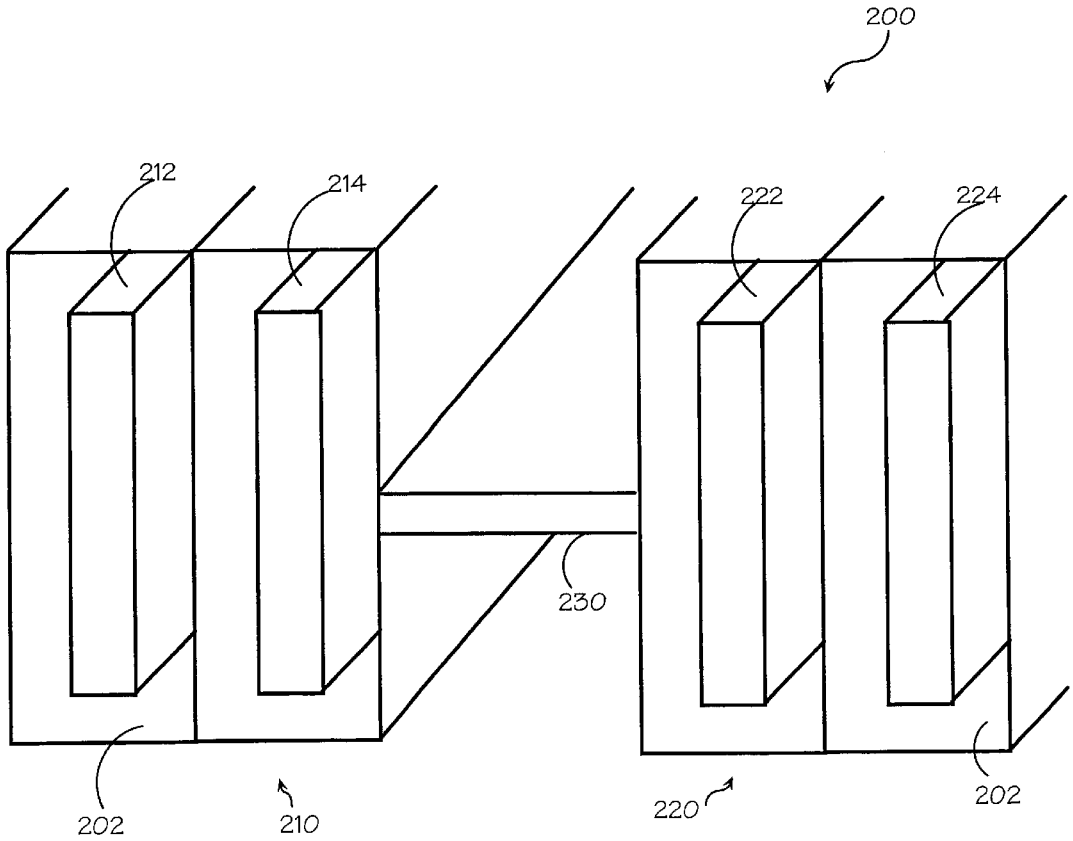
FIG. 2 is an illustration of an exemplary embodiment of the present invention wherein a first pair of conductors and a second pair of conductors are constructed utilizing a spacer so that the first pair of conductors and the second pair of conductors are at an isolated electromagnetic distance.

Referring now to FIG. 2, an exemplary embodiment of the present invention is shown wherein a first pair of conductors and a second pair of conductors are constructed utilizing a spacer so that the first pair of conductors and the second pair of conductors can be made to be at an isolated electrical and electromagnetic distance. A cable 200 includes a first pair of electrical conductors 210 and a second pair of electrical conductors 220. The first pair of conductors 210 may include a first conductor 212 and a second conductor 214 so as to create an effective electrical differential pair, for instance, suitable for operating in an even or odd mode. Likewise, the second pair of conductors 220 may include a first conductor 222 and a second conductor 224 to create an electrical differential pair. An insulator 202 may be formed to surround the electrical conductors 212, 214, 222 and 224. Thus, the present invention may provide a differential vertically paired vertical flat conductor cable (FCC) and a high density controlled impedance differential paired cable for use with low voltage differential signals (LVDS) in I/O data applications.

Additionally, a spacer 230 may be included between the first pair of electrical conductors 210 and the second pair of electrical conductors 220. Preferable, the spacer 230 is formed so as to isolate the first pair of electrical conductors 210 from the second pair of electrical conductors 220 electromagnetic field. For example, the spacer 230 may separate the pairs at an isolated electromagnetic distance. Thus, it is possible to more closely control the electrical and magnetic parameters that influence high speed signal quality in "ribbon cable". In this way, the electromagnetic envelope of the signaling environment may be controlled. In one embodiment, the electrical conductors 212, 214, 222 and 224 are flat conductors formed in generally rectangular shapes and positioned vertically to each other. For instance, the electrical conductors may be positioned orthogonal to the plane of the cable. Each pair of electrical conductors 210 and 220 include two electrical conductors 212, 214 and 222, 224 oriented generally parallel to each other. The spacer 230 may be formed at a midpoint of the connector so as to impart a generally "H" structure to the first pair of electrical conductors 210—spacer 230—second pair of electrical conductors 220 arrangement. Additionally, the "H" structure also allows a connector construct/design with insulation displacement cabling formats for connector attachment in the "middle" of the cable, instead of just at the end.

Figure 3:
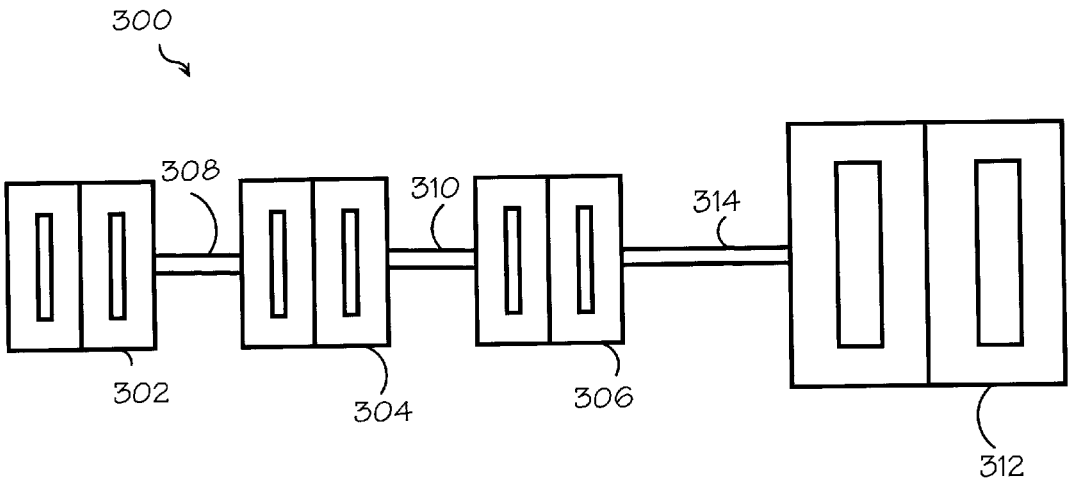
FIG. 3 is an illustration of an exemplary embodiment of the present invention wherein multiple pairs of electrical conductors are utilized to form a ribbon cable.

Referring now to FIG. 3, an exemplary embodiment of the present invention is shown wherein multiple pairs of electrical conductors are utilized to form a ribbon cable. A first pair of electrical conductors 302, a second pair of electrical conductors 304, and a third pair of electrical conductors 306 may be spaced with the use of spacers 308 and 310 disposed between the electrical conductors 302, 304 and 306. The spacing distance may be varied depending on the desired properties of the corresponding electromagnetic envelope formed by the respective conductors. For example, the interference between the second pair of electrical conductors 304 and the third pair of electrical conductors 306 may be less than the interference between the third pair of electrical conductors 306 and a fourth pair of electrical conductors 312. Therefore, a spacer 314 resulting in a greater length between conductors may be utilized between the third pair of electrical conductors 306 and the fourth pair of electrical conductors 312 than the spacer utilized between the second pair of electrical conductors 304 and the third pair of electrical conductors 306.

It should be noted that a cable 300 may be varied to include a number of conductors depending upon the number of conductive paths required for the particular application of cable 300. For instance, a variety of standards may utilize the present invention. For example, in one embodiment contemplated by the present invention, cable 300 may be compliant with a small computer system interface (SCSI) standard, such as SCSI parallel interface (SPI-4), integrated device electronics (IDE), advanced technology attachment (ATA), insulation displacement cable (IDC), insulation displacement termination (IDT), Ultra2, intelligent peripheral interface (IPI), high performance parallel interface (HIPPI), very high density cable interconnect (VHDCI) standard, and the like standard as contemplated by a person of ordinary skill in the art without departing from the spirit and scope of the present invention. For instance, in one embodiment, the cable is compliant with a very high density cable interconnect (VHDCI) standard, and is suitable for employing an insulation displacement cable (IDC) type connector. In another embodiment, the cable is compliant with the SPI-4 standard.

Figure 4:
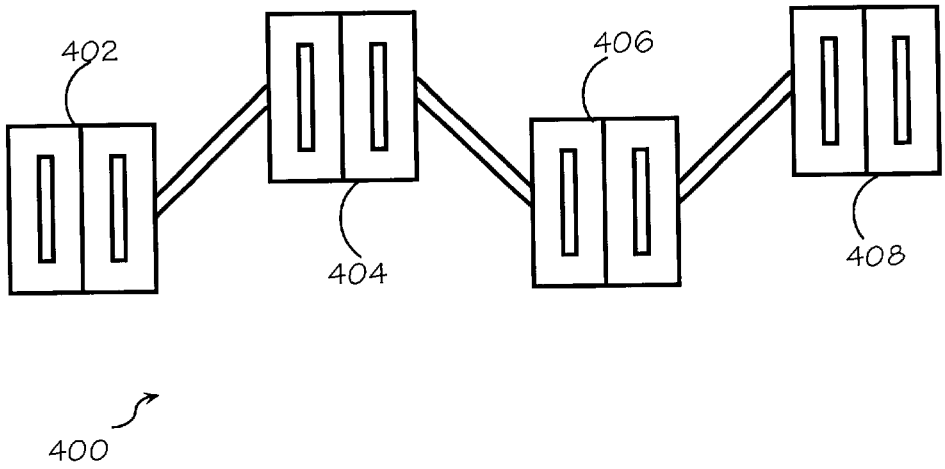
FIG. 4 is an illustration of an exemplary embodiment of the present invention wherein a cable includes staggered pairs of electrical conductors.

Referring now to FIG. 4, an exemplary embodiment of the present invention is shown wherein a cable includes staggered pairs of electrical conductors. A cable 400 may include pairs of electrical conductors 402, 404, 406 and 408 that are staggered. Staggering may provide room for displacement of insulation when utilizing a connector and also provide electromagnetic isolation. The pairs may be non-electrically bonded together for control of mechanical strength and electromagnetic properties, such as impedance, capacitance, inductance, and the like. Additionally, the electrical cable may be formed using extrusion technology, thereby enabling the cable to be produced in a time efficient and cost-effective manner.

It is believed that the electrical cable of the present invention and many of its attendant advantages will be understood by the forgoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. An electrical cable, comprising:

a first pair of electrical conductors, including a first flat conductor surrounded by an insulator;

a second flat conductor surrounded by an insulator, wherein the first flat conductor and the second flat conductor are spaced so as to form an electrical differential pair;

a second pair of electrical conductors, including a third flat conductor surrounded by an insulator;

a fourth flat conductor surrounded by an insulator, wherein the third flat conductor and the fourth flat conductor are spaced so as to form an electrical differential pair; and a spacer disposed between the first pair of electrical conductors and the second pair of electrical conductors, the spacer formed so as to isolate an electromagnetic field from the first pair of electrical conductors from an electromagnetic field from the second pair of electrical conductors, wherein the first pair of electrical conductors, the spacer and the second pair of electrical conductors are arranged to form a generally "H" shaped structure.

2. The electrical cable as described in claim 1, wherein the spacer is disposed at a midpoint between the first pair of electrical conductors and the second pair of electrical conductors.

3. The electrical cable as described in claim 1, wherein the first flat conductor and the second flat conductor are formed in generally rectangular shapes and the first flat conductor is oriented generally parallel to the second flat conductor.

4. The electrical cable as described in claim 1, wherein at least one of the first flat conductor and the second flat conductor and the third flat conductor and the fourth flat conductor are positioned orthogonal to the plane of the cable.

5. The electrical cable as described in claim 1, wherein the spacer is formed so as to isolate an electromagnetic field from the first pair of electrical conductors from an electromagnetic field from the second pair of electrical conductors by separating the first pair of electrical conductors from the second pair of electrical conductors at an isolated electromagnetic distance.

6. The electrical cable as described in claim 1, wherein the cable is suitable for compliance with at least one of small computer system interface (SCSI) standard, integrated device electronics (IDE), advanced technology attachment (ATA), insulation displacement cable (IDC), insulation displacement termination (IDT), Ultra2, intelligent peripheral interface (IPI), high performance parallel interface (HIPPI), very high density cable interconnect (VHDCI).

7. An electrical cable, comprising:

a first pair of electrical conductors, including a first flat conductor surrounded by an insulator;

a second flat conductor surrounded by an insulator, wherein the first flat conductor and the second flat conductor are spaced so as to form an electrical differential pair;

a second pair of electrical conductors, including a third flat conductor surrounded by an insulator;

a fourth flat conductor surrounded by an insulator, wherein the third flat conductor and the fourth flat conductor are spaced so as to form an electrical differential pair; and a spacer disposed between the first pair of electrical conductors and the second pair of electrical conductors, the spacer formed so as to control an electromagnetic envelope of the first pair of electrical conductors with respect to the second pair of electrical conductors, wherein the first pair of electrical conductors, the spacer and the second pair of electrical conductors are arranged to form a generally "H" shaped structure.

8. The electrical cable as described in claim 7, wherein the spacer is disposed at a midpoint between the first pair of electrical conductors and the second pair of electrical conductors.

9. The electrical cable as described in claim 7, wherein the first flat conductor and the second flat conductor are formed in generally rectangular shapes and the first flat conductor is oriented generally parallel to the second flat conductor.

10. The electrical cable as described in claim 7, wherein the first flat conductor and the second flat conductor are positioned orthogonal to the plane of the cable.

11. The electrical cable as described in claim 7, wherein the spacer is formed so as to isolate an electromagnetic field from the first pair of electrical conductors from an electromagnetic field from the second pair of electrical conductors by separating the first pair of electrical conductors from the second pair of electrical conductors at an isolated electromagnetic distance.

12. The electrical cable as described in claim 7, wherein the cable is suitable for compliance with at least one of small computer system interface (SCSI) standard, integrated device electronics (IDE), advanced technology attachment (ATA), insulation displacement cable (IDC), insulation displacement termination (IDT), Ultra2, intelligent peripheral interface (IPI), high performance parallel interface (HIPPI), very high density cable interconnect (VHDCI).

13. An electrical cable, comprising:

a first pair of electrical conductors, including a first flat conductor surrounded by an insulator;

a second flat conductor surrounded by an insulator, wherein the first flat conductor and the second flat conductor are spaced at a first distance;

a second pair of electrical conductors, including a third flat conductor surrounded by an insulator;

a fourth flat conductor surrounded by an insulator, wherein the third flat conductor and the fourth flat conductor are spaced at a second distance; and a spacer disposed between the first pair of electrical conductors and the second pair of electrical conductors, the spacer formed so as to position the first pair of electrical conductors at a third distance with respect to the second pair of electrical conductors, wherein the third distance is greater than at least one of the first distance and the second distance.

14. The electrical cable as described in claim 13, wherein the spacer is disposed at a midpoint between the first pair of electrical conductors and the second pair of electrical conductors.

15. The electrical cable as described in claim 13, wherein the first pair of electrical conductors, the spacer and the second pair of electrical conductors are arranged to form a generally "H" shaped structure.

16. The electrical cable as described in claim 13, wherein the first flat conductor and the second flat conductor are formed in generally rectangular shapes and the first flat conductor is oriented generally parallel to the second flat conductor.

17. The electrical cable as described in claim 13, wherein the first flat conductor and the second flat conductor are position orthogonal to the plane of the cable.

18. The electrical cable as described in claim 13, wherein the spacer is formed so as to isolate an electromagnetic field from the first pair of electrical conductors from an electromagnetic field from the second pair of electrical conductors by separating the first pair of electrical conductors from the second pair of electrical conductors at an isolated electromagnetic distance.

* * * * *